United States Patent [19]

Bentley

[11] 4,399,869

[45] Aug. 23, 1983

[54] PIPE WIPING METHOD AND APPARATUS

[75] Inventor: Norman P. Bentley, Wheeler, Tex.

[73] Assignee: Charlies Rental, Wheeler, Tex.

[21] Appl. No.: 437,119

[22] Filed: Oct. 27, 1982

[51] Int. Cl.[3] ..... E21B 33/08

[52] U.S. Cl. ..... 166/311; 175/84

[58] Field of Search ..... 166/311; 175/84; 251/1 B

[56] References Cited

U.S. PATENT DOCUMENTS

| | | | |
|---|---|---|---|
| 1,861,726 | 6/1932 | Trout | 251/1 B |
| 1,902,906 | 3/1933 | Seamark | 175/84 X |
| 2,401,960 | 6/1946 | Pranger | 175/84 X |
| 2,746,709 | 5/1956 | Minor | 251/1 B |
| 2,843,349 | 7/1958 | Meyer | 251/1 B |

FOREIGN PATENT DOCUMENTS

| | | | |
|---|---|---|---|
| 596049 | 4/1960 | Canada | 251/1 B |
| 776306 | 6/1957 | United Kingdom | 251/1 B |

*Primary Examiner*—Stephen J. Novosad

*Attorney, Agent, or Firm*—C. Clark Dougherty, Jr.

[57] ABSTRACT

The present invention relates to improved methods and apparatus for removing drilling mud and other substances from the outside surfaces of drill pipe as the drill pipe is removed from a wellbore. The apparatus is comprised of a housing adapted to be attached over a wellbore and positioned whereby the drill pipe passes through the housing, an inflatable pipe wiping member formed of resilient material having a central passage formed therein for providing wiping contact with the outside surfaces of the drill pipe attached within and to the housing and means for selectively flowing a gas under pressure into or out of the pipe wiping member whereby the member can be selectively expanded or contracted to increase or decrease the force of wiping contact with the drill pipe. Improved methods of removing drilling mud and other substances from the outside surfaces of drill pipe as the drill pipe is pulled out of a wellbore are also provided.

6 Claims, 8 Drawing Figures

PIPE WIPING METHOD AND APPARATUS

BACKGROUND OF THE INVENTION

1. Field of the Invention

The present invention relates generally to pipe wiping methods and apparatus and, more particularly, but not by way of limitation, to improved methods and apparatus for removing drilling mud and the like from drill pipe as it is removed from a wellbore by a drilling rig.

2. Description of the Prior Art

In the drilling of wells penetrating subterranean producing formations, various drilling fluids are utilized to maintain hydrostatic head on the formation being drilled, to lubricate the drill bit and to carry cuttings from the drill bit to the surface. Such drilling fluids are commonly referred to as drilling muds.

The drill bit is connected by a string of threadedly connected together drill pipe sections to a drilling rig at the surface. The drilling rig rotates the string of drill pipe and drill bit and additional drill pipe sections are continuously added to the drill string as the drilling progresses. When it is necessary to withdraw the string of drill pipe and drill bit from the wellbore, such as for the purpose of replacing a worn-out drill bit, the drill string is pulled out of the wellbore one drill pipe section at a time and the sections are disconnected. As the drill pipe sections are pulled out of the wellbore, the outside surfaces of the sections are covered with drilling fluid which makes their handling difficult, causes the floor of the drilling rig to be covered with drilling fluid which is slippery and hazardous to drilling rig personnel, brings about the waste of the drilling fluid and causes pollution of the atmosphere in that drilling fluids usually always contain some atmosphere polluting components.

Methods and apparatus for removing drilling fluid, oil and other substances from the outer surfaces of drill pipe have been developed and utilized heretofore. For example, in my co-pending U.S. patent application Ser. No. 334,968 filed Jan. 20, 1982, a pipe wiper apparatus is disclosed for installation over a wellbore which wipes drilling fluid from the surfaces of drill pipe as the drill pipe is pulled out of the wellbore. That apparatus includes a resilient annular ring formed of a size such that the central opening in the ring fits tightly against the outside surfaces of drill pipe. As the drill pipe is pulled through the ring it wipes drilling mud and other substances from the pipe. While such apparatus has been utilized successfully in drilling rig operations, the resilient annular wiping ring of the apparatus must be replaced on a relatively frequent basis since its wiping surfaces are continuously worn away as drill pipe is pulled through the apparatus.

By the present invention an improved pipe wiping method and apparatus are provided which bring about the more efficient wiping and removal of drilling fluid and the like from the outside surfaces of drill pipe, require much less frequent replacement of the resilient wiping member and provide a positive seal between the apparatus and the drill pipe which can facilitate the prevention of blowouts, etc.

SUMMARY OF THE INVENTION

A method of removing drilling fluid and other substances from the outside surfaces of drill pipe as the drill pipe is pulled out of a wellbore comprising the steps of placing an inflatable annular pipe wiping member formed of resilient material over the wellbore and around the drill pipe, inflating the pipe wiping member with a pressurized gas to a pressure level whereby the pipe wiping member is brought into the desired degree of wiping contact with the drill pipe and pulling the drill pipe through the pipe wiping member as the drill pipe is pulled out of the well bore so that drilling mud and other substances on the drill pipe are wiped therefrom and returned to the wellbore. Apparatus for carrying out the methods of the present invention are also provided.

It is, therefore, a general object of the present invention to provide improved pipe wiping methods and apparatus.

A further object of the present invention is the provision of methods and apparatus for removing drilling fluid and other similar substances from the outside surfaces of drill pipe as the drill pipe is withdrawn from a wellbore which are more economical to carry out and more efficient than prior art methods.

Another object of the present invention is the provision of improved apparatus for removing drilling fluid and the like from drill pipe wherein the resilient wiping member has a long service life.

Yet another object of the present invention is the provision of apparatus for removing drilling fluid and the like from drill pipe which can also be utilized to provide a seal between the casing and the drill pipe to facilitate the prevention of blowouts, etc.

Other and further objects, features an advantages of the present invention will be readily to those skilled in the art upon a reading of the description of preferred embodiments which follows when taken in conjunction with the accompanying drawings.

DESCRIPTION OF PREFERRED EMBODIMENTS

Figure 1:
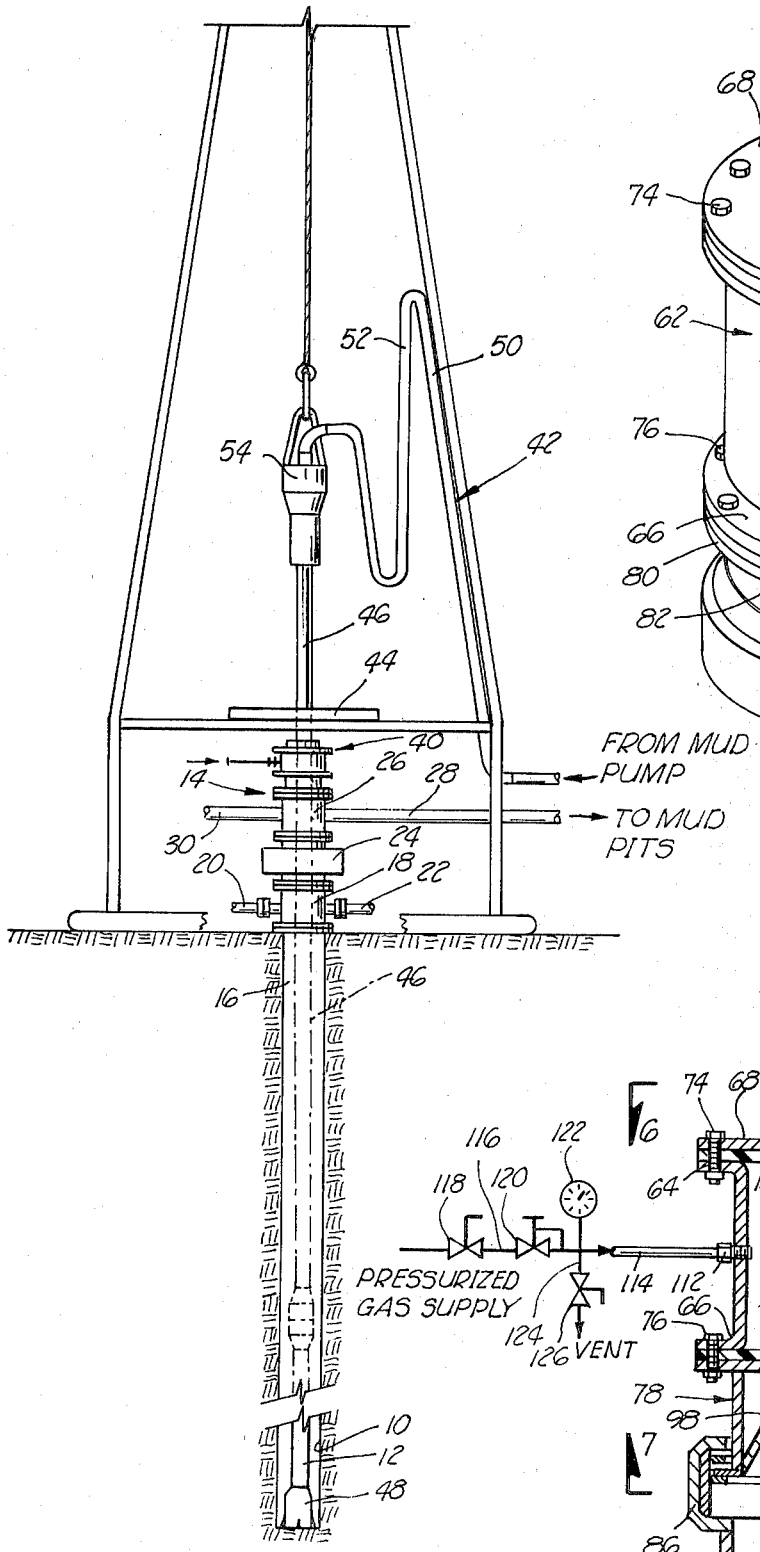
FIG. 1 illustrates a wellbore having conventional rotary head structure connected thereto including the apparatus of the present invention with a conventional rotary drilling rig positioned thereover.

Referring now to the drawings and particularly to FIG. 1, a wellbore 10 is illustrated having a conventional drill string 12 made up of conventional threadedly connected drill pipe sections disposed therein. The wellbore 10 is equipped with the usual arrangement of rotary head apparatus, generally designated by the numeral 14, including surface casing 16 disposed in the wellbore 10 connected to a drilling spool 18 at the ground surface. A pair of conduits 20 and 22 are connected to the drilling spool 18 which are connected to a source of weighted drilling fluid and a gas flowline, respectively. In the event of a blowout, weighted drilling fluid is introduced into the wellbore by way of the conduit 20 and formation fluids under pressure are relieved from the wellbore by way of the conduit 22 and flowline connected thereto.

One or more conventional blowout preventer apparatus 24 are connected to the drilling spool 18 and a conventional bell nipple 26 is connected above the blowout preventers 24. A large diameter conduit 28 is connected to the bell nipple 26 for conducting circulated drilling fluid and cuttings suspended therein from the annulus between the drill string 12 and the walls of the wellbore 10 to mud pits (not shown). A second conduit 30 is connected to the bell nipple 26 for introducing makeup drilling fluid into the annulus. The pipe wiping apparatus of the present invention, generally designated by the numeral 40, is connected to the top of the bell nipple 26. As is well understood by those skilled in the art, other arrangements of rotary head apparatus can be used, but in all such arrangements, the apparatus 40 is connected therein above the bell nipple 26 or its equivalent.

A conventional rotary drilling rig 42 is positioned above the wellbore 10 and the rotary head 14. The rig 42 includes a rotary table 44 for engaging and rotating the kelly 46. The kelly 46 is in turn attached to the upper end of the drill string 12 which, as indicated above, is comprised of a plurality of drill pipe sections threaded together end-to-end. A drill bit 48 is connected to the bottom end of the drill string 12 and as the drill string 12 is rotated thereby rotating the drill bit 48 against the bottom of the wellbore 10, drilling fluid is circulated downwardly through the kelly 46 and the drill string 12, through nozzles in the drill bit 48, upwardly through the annulus between the drill string 12 and the walls of the wellbore 10, through the rotary head apparatus 14 and then through the conduit 28 to the mud pits. Cuttings produced by the drill bit 48 are removed from the drilling fluid and conditioned drilling fluid is pumped by mud pumps (not shown) from the mud pits into and through the usual standpipe 50 and flexible hose 52. The flexible hose 52 is connected to a swivel 54 suspended in the drilling rig which is in turn connected to the top end of the kelly 46.

In operation of the drilling rig 42, the rotary table 44 rotates the kelly 46, the drill string 12 and the drill bit 48 as the drilling fluid is circulated through the wellbore to deepen the wellbore. As the wellbore is deepened, additional sections of drill pipe are added to the drill string in the usual manner to increase its length.

When it is necessary to raise or remove the drill string from the wellbore, the drill string is raised one drill pipe section at a time with the top drill pipe section being disengaged from the drill string. As the drill string is pulled out of the wellbore, the outside surfaces of the drill pipe are covered with drilling fluid, oil and/or other substances which, as indicated above, cause a hazardous condition for drilling rig operating personnel and are atmosphere polluting if not removed. The apparatus 40 of the present invention connected on top of the bell nipple 26 functions to continuously remove the drilling fluid and other substances from the drill pipe as it is pulled out of the wellbore and through the apparatus 40 and to return the drilling fluid and other substances to the wellbore.

Figure 2:
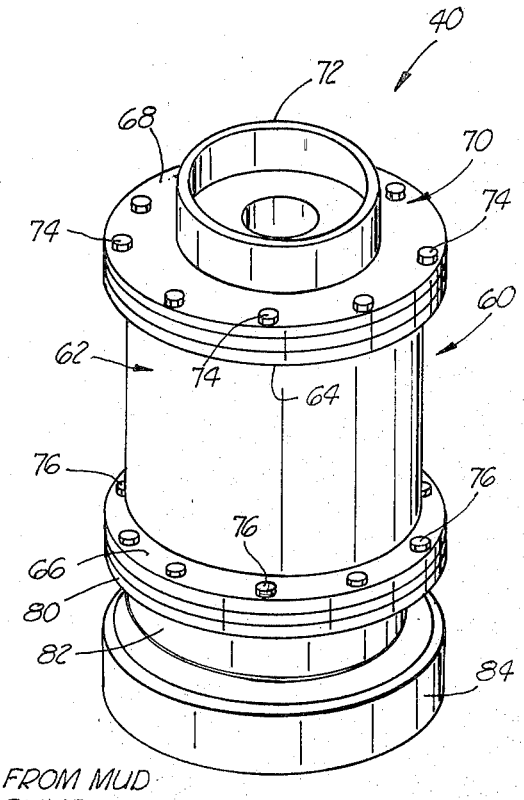
FIG. 2 is a perspective view of the apparatus of the present invention.
Figure 3:
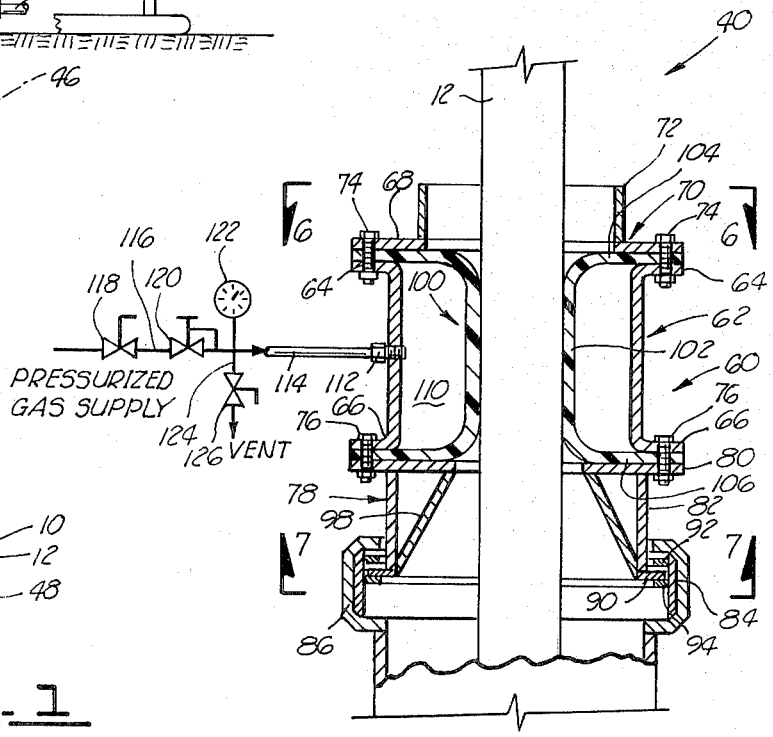
FIG. 3 is a side elevational view of the apparatus of FIG. 2 taken in cross section and shown connected to the rotary head structure of FIG. 1.
Figure 4:
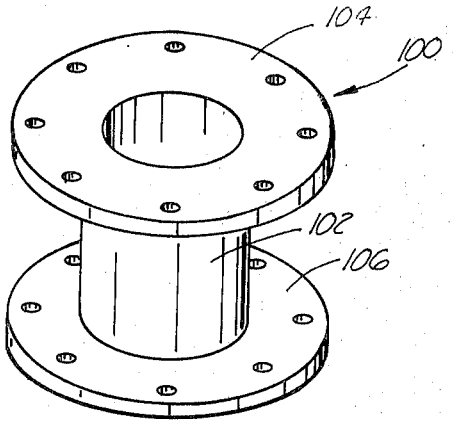
FIG. 4 is a perspective view of the resilient wiping member of the present invention.
Figure 5:
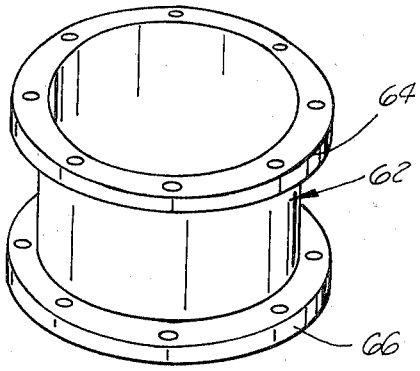
FIG. 5 is a perspective view of the cylindrical body member of the housing of the present invention.
Figure 6:
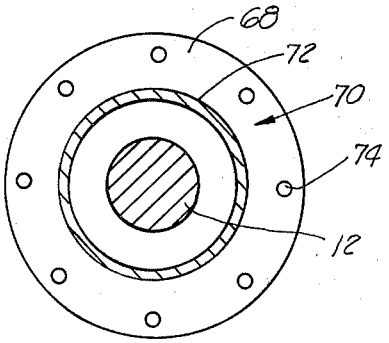
FIG. 6 is a cross-sectional view taken along line 6—6 of FIG. 3.

Referring now to FIGS. 2–8 a presently preferred form of the apparatus of the present invention is illustrated. As best shown in FIGS. 2, 3 and 5, the apparatus 40 includes a metal, generally cylindrical housing 60 comprised of a cylindrical body member 62, a top member 70 and a bottom member 78. The cylindrical body member 62 includes outwardly extending flanges 64 and 66 formed at the top and bottom thereof, respectively. Each of the flanges 64 and 66 includes a plurality of openings disposed in spaced relationship therearound for accommodating the passage of threaded connecting members therethrough such as studs.

The annular top member 68 which includes a flange portion 70 and an upstanding cylindrical central portion 72 is connected to the top flange 64 of the cylindrical body member 62. That is, the flange portion 68 of the top member 70 includes openings therein which are complementary to the openings in the flange 64 of the cylindrical body member 62 and is connected to the flange 64 by a plurality of studs and nuts 74.

Connected to the bottom flange 66 of the cylindrical body member 62 by a plurality of studs and nuts 76 is a bottom member 78. The bottom member 78 includes a top flange 80 of complementary size and shape to the flange 66 of the member 62 which is connected to the member 62 and a cylindrical lower body portion 82 to which a connector ring 84 for connecting the housing 60 to the rotary head structure is attached.

The connector ring 84 can take various forms depending upon the particular structure on the rotary head assembly to which it is to be attached. In FIG. 3, the connector ring 84 is shown connected into a conventional connector apparatus 86 which is in turn attached to the bell nipple 26.

Figure 7:
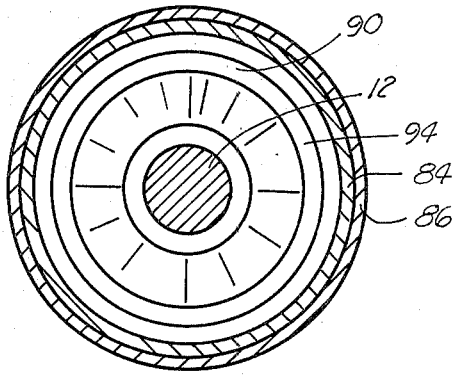
FIG. 7 is a cross-sectional view taken along line 7—7 of FIG. 3.

As best shown in FIGS. 3 and 7, the cylindrical portion 82 of the bottom member 78 includes an outwardly extending flange 90 attached to the lower end thereof. The flange 90 is positioned between a pair of inwardly extending spaced-apart ring members 92 and 94 which are rigidly attached to the connector ring 84. Thus, the flange 90 attached to the bottom member 78 and the housing 60 are free to move or tilt within the confines of the rings 92 and 94, as will be described further hereinbelow.

Still referring to FIGS. 3 and 7, a conically shaped metal liner 98 is connected within the cylindrical portion 82 of the bottom member 78, such as by welding to provide a smooth diverging surface therein. That is, the conically shaped liner 98 functions to guide protruding portions of the drill string 12 through the internal portion of the housing 60 without becoming snagged or otherwise hung up on sharp corners therein.

Figure 8:
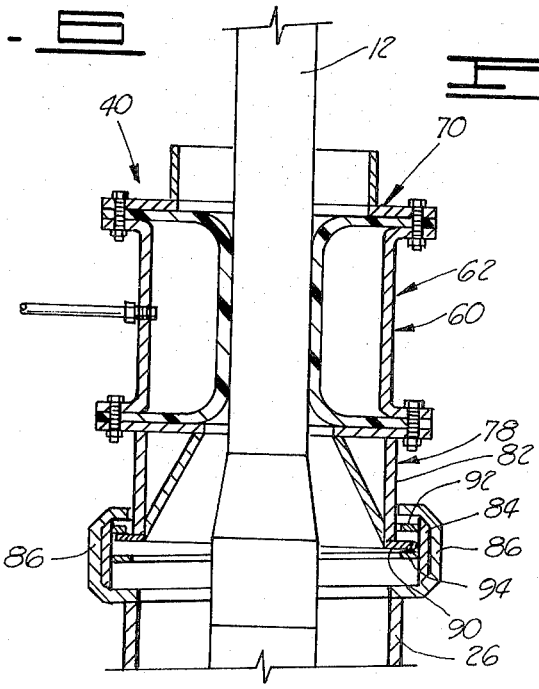
FIG. 8 is a side cross-sectional view similar to FIG. 3 but showing the apparatus in a tilted position.

As shown best in FIGS. 3 and 4, disposed within the housing 60 of the apparatus 40 is an inflatable pipe wiping member 100 for providing wiping contact with the outside surfaces of the drill string 12 as shown in FIG. 3. The pipe wiping member 100 is of annular shape and includes a cylindrical interior portion 102, the inside surfaces of which contact the drill pipe, integrally connected to top and bottom flange portions 104 and 106, respectively. The peripheral end portions of the flange portions 104 and 106 include a plurality of openings therein which complement the openings in the flanges 64, 66, 68 and 80 of the members 62, 70 and 78 making up the housing 60. As shown in FIGS. 2, 3 and 8, the flange portions 104 of the pipe wiping member 100 is clamped between the flanges 64 and 68 and the flange portion 106 is clamped between the flanges 66 and 80 whereby a sealed annular space 110 is formed between the interior of the cylindrical body member 62 and the pipe wiping member 100. A gas connection 112 is sealingly connected to the cylindrical body member 62 which communicates the annular space 110 with a conduit 114 which is connected thereto. The conduit 114 is connected to a pressurized gas supply by way of a header 116 which has a shutoff valve 118 and a pressure regulator 120 disposed therein. A pressure gauge 122 and a vent line 124 with shutoff valve 126 disposed therein are connected to the header 116 downstream of the valve 118 and regulator 120.

Operation of the Apparatus 40

The drill string 12 disposed in the wellbore 10 is connected to the kelly 46 which passes through the rotary head assembly 14 and apparatus 40 while the wellbore is being drilled. When all or part of the drill string 12 is withdrawn from the wellbore 10, it is pulled through the apparatus 40 as shown in FIG. 3. Prior to pulling the drill pipe through the apparatus 40, pressurized gas, preferably compressed air, is caused to flow into the annular space between the housing member 62 and the pipe wiping member 100 to thereby inflate the pipe wiping member 100. The inflation of the pipe wiping member 100 brings it into contact with the drill string 12 as it is pulled through the apparatus 10 with enough force to efficiently wipe drilling fluid and other substances from the outside surfaces thereof.

While various controls and systems can be used to control the pressure level of air or other gas in the apparatus 40, one such system is illustrated in FIG. 3. When the member 100 is inflated, the valve 118 is opened and the regulator 120 adjusted to the desired pressure level as indicated on the pressure gauge 122. If it is desired to increase the force brought against the drill pipe by the pipe wiping member 100, the pressure regulator 120 is adjusted upwardly to raise the pressure of the gas within the inflated member 100. If too much force is exerted, the pressure regulator is adjusted downwardly and the vent valve momentarily opened to lower the pressure. Thus, the pressure level in the inflatable pipe wiping member 100 of the apparatus 100 can be selectively controlled to control the force of the wiping contact on the drill pipe by the pipe wiping member 100 as the drill pipe is being withdrawn from the wellbore to insure the most efficient wiping action and complete removal of drilling fluid and other substances from the outside surfaces of the drill pipe.

As will be understood, the wiping action of the member 100 causes drilling fluid and other substances on the drill pipe surfaces to be removed and accumulated on the lower end portion of the member 100. From the member 100, the accumulated substances fall or run downwardly within the bottom member 78 of the housing 60 into the rotary head assembly and the wellbore 10.

As shown in FIG. 8, during the operation of the apparatus 40 and the withdrawal of all or part of the drill string 12 from the wellbore 10, the drill string can become misaligned with the longitudinal axis of the apparatus 40 placing a strain on the apparatus 40 and causing the pipe wiping member 100 to be deformed. In order to prevent damage to the apparatus 40 and the pipe wiping member 100 thereof, the connector ring 84 is attached to the bottom member 78 of the housing 60 in a manner whereby the housing 60 can swivel or tilt with respect to the rotary head assembly. That is, as previously described, the bottom member 78 of the housing 60 includes a flange portion 90 which is retained between a pair of spaced-apart rings 92 and 94 attached to the connector ring 84. Thus, as shown in FIG. 8, the housing 60 can tilt with respect to the connector ring 84 and other components of the rotary head to which it is attached thereby preventing damage to the apparatus 40.

As will now be understood by those skilled in the art, if it is desired to seal the annulus between the drill string 12 and the wellbore 10 at the rotary head such as in the event of a blowout, the pressure of the gas inflating the pipe wiping member 100 of the apparatus 40 can be increased to a level whereby the pipe wiping member 100 forceably contacts the drill string 12 or the kelly 46 connected thereto to seal the annulus.

Thus, the apparatus 40 finds various uses in the drilling of wellbores, the principal use being the continuous and automatic removal of drilling fluid, oil and other substances from the outer surfaces of drill pipe when the drill pipe is withdrawn from a wellbore whereby the drilling fluid and other substances do not make the drill pipe difficult to handle, spill onto the floor of the rig making operations hazardous for personnel and flow onto the ground whereby the atmosphere is polluted.

Thus, the present invention is well adapted to carry out the objects and attain the advantages mentioned as well as those inherent therein. While numerous changes in the construction and arrangement of parts will suggest themselves to those skilled in the art, such changes are encompassed within the spirit of this invention as defined by the appended claims.

What is claimed is:

1. A method of preventing the loss of drilling fluid, oil and other similar substances from a wellbore on the outer surfaces of drill pipe when the drill pipe is pulled out of the wellbore comprising the steps of:

placing an inflatable annular pipe wiping member formed of resilient material over said wellbore and around said drill pipe;

inflating said pipe wiping member with a pressurized gas to a pressure level whereby said pipe wiping member is brought into forcible wiping contact with said drill pipe when said drill pipe is pulled out of said wellbore;

pulling said drill pipe through said pipe wiping member as said drill pipe is pulled out of said wellbore so that drilling mud, oil and other substances on said drill pipe are wiped therefrom and returned to said wellbore; and deflating said pipe wiping member whereby said pipe wiping member is removed from forcible contact with said drill pipe when said drill pipe is rotated or moved downwardly.

2. The method of claim 1 wherein said inflatable annular pipe wiping member is attached within a housing which is in turn connected over said wellbore whereby said drill pipe passes through said housing.

3. The method of claim 1 which is further characterized to include the step of changing the pressure level of said pressurized gas inflating said pipe wiping member while said drill pipe is being pulled through said apparatus to thereby change the degree of wiping achieved by said apparatus.

4. The method of claim 1 wherein said pressurized gas is air.

5. Apparatus for removing drilling mud and other substances from the outside surfaces of drill pipe as the drill pipe is pulled out of a wellbore comprising:

a housing adapted to be positioned whereby said drill pipe passes through said housing as it is pulled out of said wellbore comprised of:

a cylindrical body member having flanged connection means formed at the top and bottom thereof;

an annular top member having a flange connection means formed thereon engaged with the top flange connection means of said cylindrical body member; and a substantially cylindrical bottom member adapted to be attached over said wellbore at the bottom end thereof and having a flange connection means formed thereon at the top thereof engaged with the bottom flange connection means of said cylindrical body member, said bottom member including a conical liner attached interiorly thereof;

a hollow pipe wiping member formed of resilient material having a central passage for providing wiping contact with the outside surfaces of said drill pipe formed therein, said wiping member including a cylindrical interior portion and outwardly extending circular top and bottom flange portions, the peripheral ends of said flange portions being sealingly connected between the flange connection means of said cylindrical body, top member and bottom member of said housing whereby a sealed annular gas space is formed internally and between said resilient pipe wiping member and said cylindrical body member and whereby said drill pipe passes through said interior portion of said wiping member; and means sealingly attached to said housing for selectively flowing a gas under pressure into or out of said sealed annular gas space between said pipe wiping member and said cylindrical body member of said housing whereby said pipe wiping member can be selectively inflated or deflated to increase or decrease the force of wiping contact thereof with said drill pipe.

6. The apparatus of claim 5 wherein said bottom member of said housing is further characterized to include swivel means attached thereto and to said means for connecting said member over said wellbore for allowing limited angular movement between said housing and said means for connecting said housing over said wellbore.

* * * * *